US006297717B1

(12) United States Patent
Heckenkamp

(10) Patent No.: US 6,297,717 B1
(45) Date of Patent: Oct. 2, 2001

(54) CONTACTOR WITH FLOATING ARMATURE

(75) Inventor: Daniel P. Heckenkamp, Oconomowoc, WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/523,269

(22) Filed: Mar. 10, 2000

(51) Int. Cl.[7] ..... H01H 67/02
(52) U.S. Cl. ..... 335/132
(58) Field of Search ..... 335/131, 132, 335/202; 200/293–308

(56) References Cited

U.S. PATENT DOCUMENTS 3,458,838 * 7/1969 Isler ..... 335/132
3,710,288 * 1/1973 Grunert ..... 335/160
3,748,608 * 7/1973 Grunert et al. ..... 335/132
3,840,830 * 10/1974 Hardman ..... 335/132
4,525,694 * 6/1985 Dennison et al. ..... 335/132
5,717,370 * 2/1998 Haas ..... 335/132

* cited by examiner

*Primary Examiner*—Lincoln Donovan
(74) *Attorney, Agent, or Firm*—Timothy J. Ziolkowski

(57) ABSTRACT

An electro-mechanical contactor is disclosed having a powerhead and a base housing. The powerhead has a set of stationary contacts mounted therein. A set of movable contacts are mounted on a movable contact carrier that moves the movable contacts between a contact open position and a contact closed position with respect to the stationary contacts. The movable contact carrier has an armature slot integrally molded therewith to loosely receive an armature therein so as to allow the armature to float within the movable contact carrier and the powerhead. The powerhead has a powerhead housing configured to guide and retain the floating armature during normal operation. Extended life of the contactor is achieved by eliminating a rigid mounting between the armature and the movable contact carrier.

20 Claims, 5 Drawing Sheets

CONTACTOR WITH FLOATING ARMATURE

BACKGROUND OF THE INVENTION

The present invention relates generally to electromagnetic contactors, and more particularly to a contactor having a floating armature therein.

An electrical contactor is a switch that is adapted to open and close repeatedly to supply and interrupt electrical power to electrical loads, such as motors and the like. An electromagnetic contactor is a contactor that is caused to operate by an electromagnet. The movable contacts are moved from an open position to a closed position by an armature attached to a movable contact carrier assembly depending on the magnetism produced by a coil. The armature is typically mounted to the carrier with fasteners, such as rivets. Other contactors use spring clips either bearing against the surface of the armature or through an aperture in the armature to retain the armature tightly against the carrier.

It has been determined that such configurations can limit the life of a contactor. For example, if the fasteners, such as rivets, break or become loose, the armature can bind, or worse, the contactor can become completely inoperable. Further, a coil can apply an inconsistent magnetic force and/or the physical clearance between the carrier and the housing can cause "window locking." This results from the carrier tilting within the housing, thereby causing the carrier to bind within the housing during its travel from one position to the next.

While such prior art retention means between the armature and the carrier have functioned adequately, there is an ongoing manufacturing need to simplify assembly, reduce cost, and improve operation of the contactor.

It would therefore be advantageous to have a molded one piece carrier assembly that can retain an armature loosely therein and thereby extend the overall life of the contactor.

SUMMARY OF THE INVENTION

The present invention provides an electromagnetic contactor in which the armature is loosely attached/connected to the contact carrier, and is slideably guided within the contactor to retain the armature within the connecting structure of the carrier that provides extended life and easy assembly.

In accordance with one aspect of the invention, an electrical contactor includes a housing having a set of stationary contacts mounted therein and a set of movable contacts located on a contact carrier within the housing. The movable contacts being in operable association with the stationary contacts, such that when the contacts close, electric power is supplied to a load. The contact carrier has an armature slot integrally molded therewith. An armature is loosely situated in the armature slot of the contact carrier so as to float therein. In this manner, the armature is easily inserted into the carrier while the carrier assembly is mounted in the housing. Moreover, the carrier is less likely to experience window locking that is typically caused by the armature being tightly bound to the carrier.

According to another aspect of the invention, a contactor is disclosed having a floating armature within a contactor housing. The housing has an armature stop and an armature channel to maintain the floating armature in a desired position and aligned with a return spring. A contact carrier is provided having an armature slot integrally molded therewith and having side channels to loosely retain the floating armature therein. The housing has two elongated sides that are parallel to a length of the armature. Each elongated side has a carrier ear slot therein to accept one of the pair of offset ears of the carrier. The housing walls guide the ends of the armature while moving vertically within the housing to maintain the armature position within the carrier.

The present invention provides numerous manufacturing advantages. For example, by providing an armature slot integrally molded with the carrier, no additional fastening means are necessary for attaching the armature to the carrier. By not fixing the armature securely to the carrier, during operation of the contactor, the armature does not exert excessive torsional force on the carrier thereby preventing window locking. During life tests, it was found that the floating armature arrangement of the present invention significantly reduced the load on the carrier during operation and resulted in a significant increase in life of the contactor.

Various other features, objects and advantages of the present invention will be made apparent from the following detailed description and the drawings.

BRIEF DESCRIPTION OF THE DRAWINGS

The drawings illustrate the best mode presently contemplated for carrying out the invention.

In the drawings.

DETAILED DESCRIPTION OF THE PREFERRED EMBODIMENT

Figure 1:
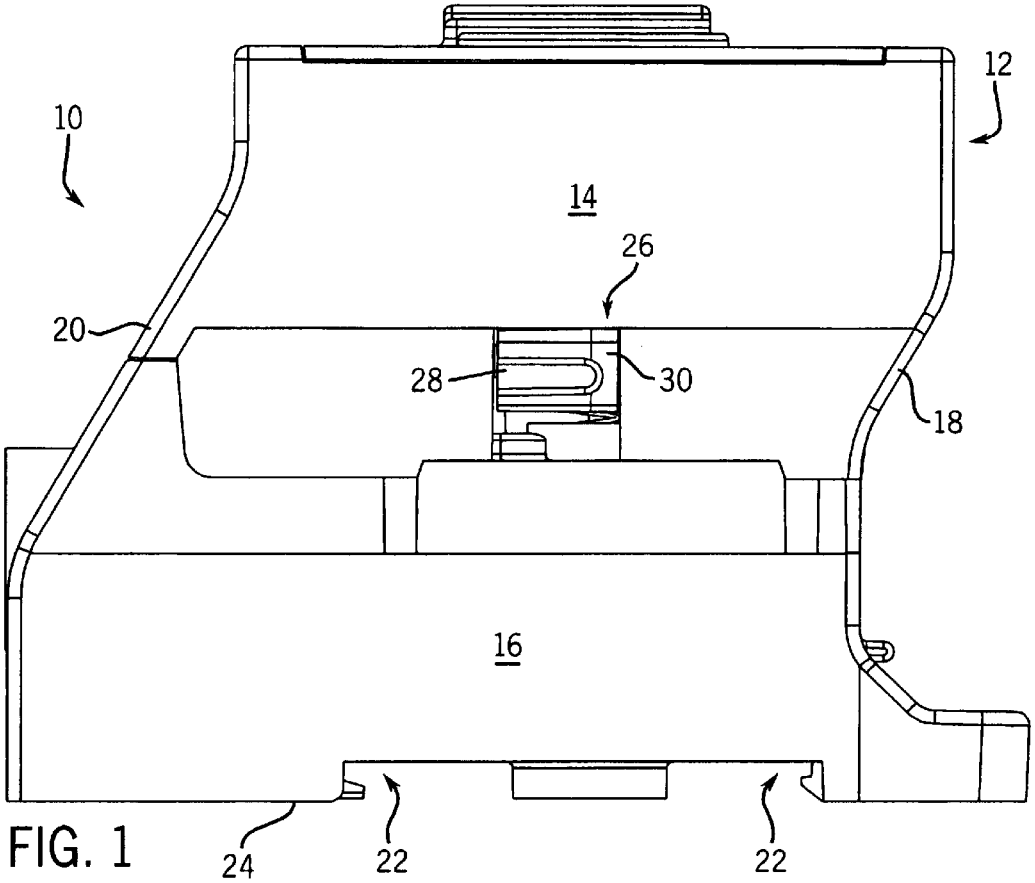
FIG. 1 is a side, elevation view of an electrical contactor incorporating the present invention.

FIG. 1 shows an electromechanical contactor 10 having a contactor powerhead 12 enclosed in a powerhead housing 14 and mounted in a base housing 16. The contactor 10 is connected to a load (not shown), such as a motor, through a number of terminals on one end 18. The contactor 10 receives power to a number of terminals on the other end 20 to relay power to the motor. The base housing 16 has a mounting slot 22 on a lower end 24 to engage a rail (not shown) for mounting the contactor 10. A mechanical interlock 26 is provided for use with an adjacent contactor to prevent both contactors from being energized simultaneously. The interlock 26 includes an interlock aperture 28 in a movable contact carrier 30 that is engageable with another contactor (not shown) to lock one contactor when another is energized. Such an interlock is especially advantageous when a pair of contactors are used to control a reversing motor to operate the motor in both a forward and a reverse direction.

Figure 2:
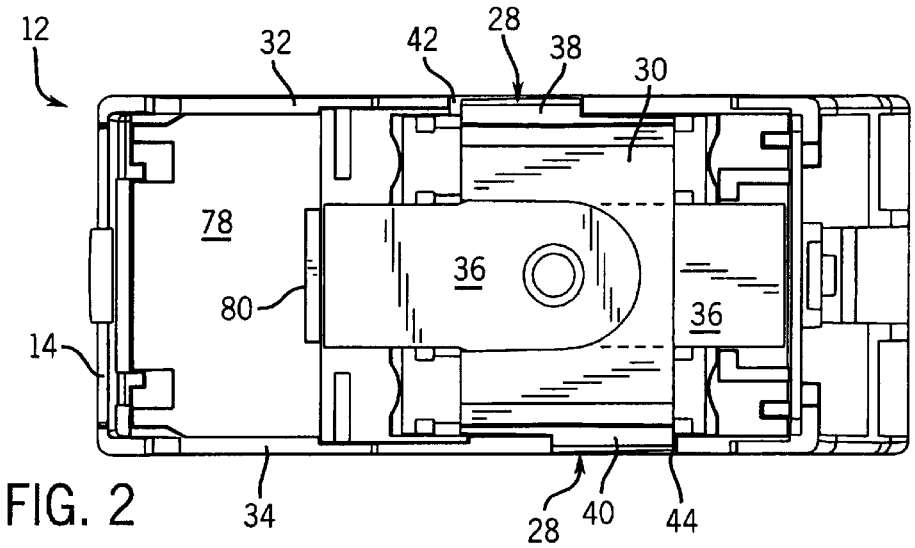
FIG. 2 is a bottom view of a portion of FIG. 1.

Referring to FIG. 2, the contactor powerhead 12 is shown from the bottom with the base housing 16 of FIG. 1 removed therefrom. The contactor powerhead 12 is enclosed in the powerhead housing 14 which has two elongated sides 32, 34 that run parallel with a length of an armature 36. The movable contact carrier 30 has a pair of offset ears 38, 40, each of which has therein an interlock aperture 28, as best shown in FIG. 1. The offset ears 38, 40 are retained within a carrier ear slot 42, 44 in each of the elongated sides 32, 34 of the powerhead housing 14 to guide and retain the movable contact carrier 30.

Figure 3:
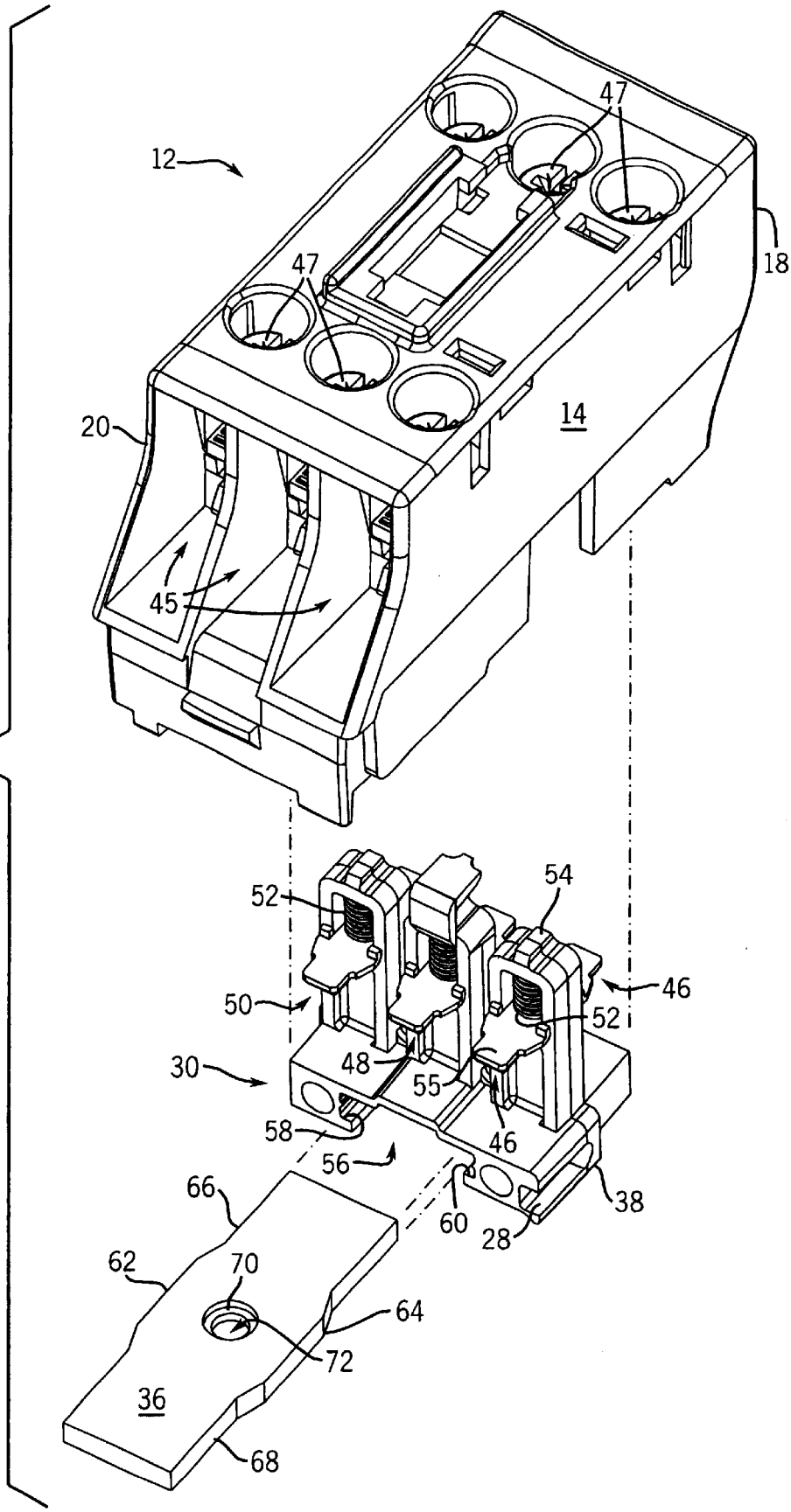
FIG. 3 is a perspective view of the contactor of FIG. 1, partially exploded.

Since the armature 36, FIG. 3, is metallic and the movable contact carrier 30 is molded plastic, the invention further includes a combination wherein the armature slot 56 of the carrier assembly 30 has a pair of W-shaped side grooves 58, 60 in which the armature 36 slides through. The armature 36 has a pair of side extensions 62, 64 that extend centrally from each elongated side 66, 68 of the armature 36. This combination limits lateral movement of the armature 36 within the movable contact carrier 30 and prevents any sharp comers of the metallic armature 36 from contacting and prematurely eroding the plastic movable contact carrier 30. That is, with this arrangement, the armature 36 can be stamped manufactured, and the sharp comers that commonly result from the stamping process do not have to be machined away, which further reduces manufacturing expense. Additionally, the plastic carrier 30 can be molded with comer fillets that prevent stress cracks that commonly occur in right angle comers in plastic moldings. FIG. 3 also shows a recess 70 in the armature 36 having an aperture 72 therein. The recess 70 is located on both sides of the armature 36, as best viewed in FIG. 6, to thereby allow the armature to be installed within the carrier with either side facing up, thereby simplifying assembly.

Figure 4:
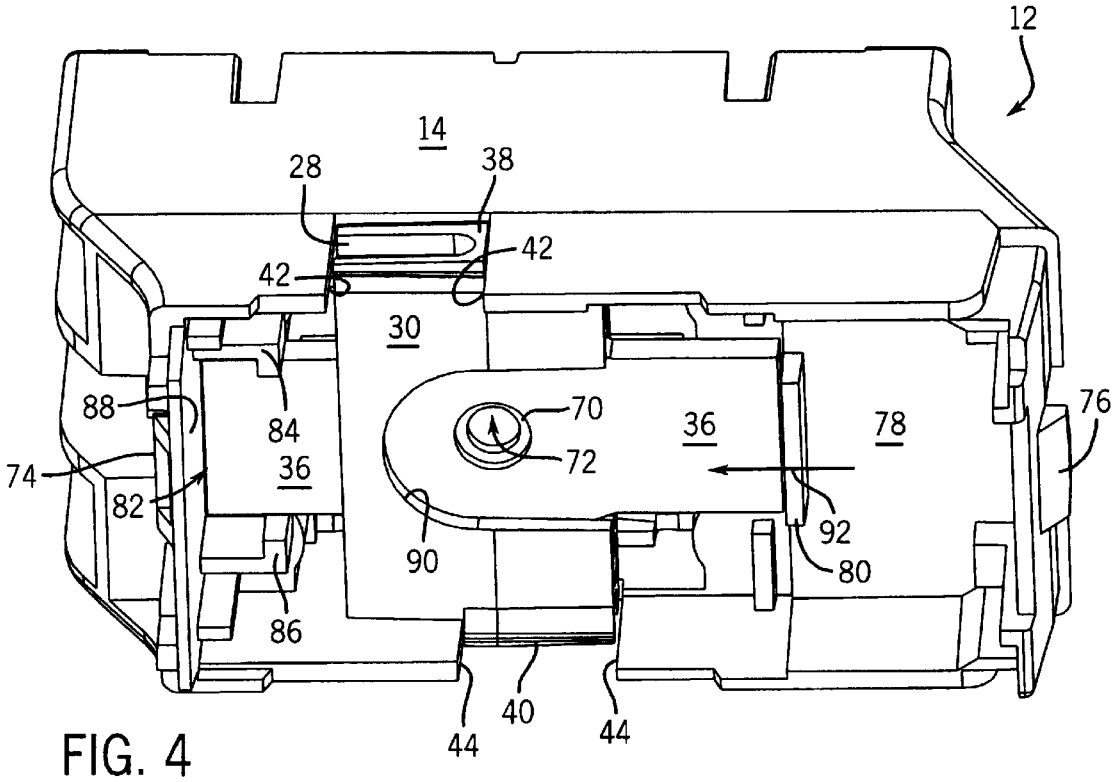
FIG. 4 is a perspective view of the contactor of FIG. 1, as viewed upwardly from the bottom, rear side.

Referring now to FIG. 4, the contactor powerhead 12 is shown in perspective as viewed from a bottom side. The powerhead housing 14, has front and back locking clasps 74, 76 to engage the lower base housing 16, as will be further described with reference to FIG. 5. The powerhead housing 14 has a bottom surface 78 having an armature stop 80 that prevents the floating armature 36 from moving rearwardly during normal operation. Housing 14 also has an armature channel 82 to guide the armature 36 laterally. The armature channel 82 includes a pair of downwardly extending bosses 84, 86 and a front panel 88. Referring to the movable contact carrier 30, a U-shaped lower retention portion 90 spans across the movable contact carrier 30 from the offset ear 38 to the offset ear 40. The U-shaped lower retention portion 90 allows inserting the armature 36 while the movable contact carrier 30 is in the housing in that since the armature 36 is spring-loaded, grasping the offset ears 38 and 40 and pulling downwardly, as viewed in FIG. 4, the armature 36 can clear the armature stop 80 and be inserted forwardly, as indicated by arrow 92. The movable contact carrier 30 also has an armature slot 56 integrally molded therewith. The armature slot 56 is designed such that the armature 36 is loosely situated in the movable contact carrier 30 so as to float therein. The armature 36 moves the carrier between a contact open position and a contact closed position by the magnetic forces created by a magnet and coil assembly 100, as shown in FIGS. 5 and 6, and as is known in the art.

Since the armature 36, FIG. 3, is metallic and the movable contact carrier 30 is molded plastic, the invention further includes a combination wherein the armature slot 56 of the carrier assembly 30 has a pair of W-shaped side grooves 58, 60 in which the armature 36 slides through. The armature 36 has a pair of side extensions 62, 64 that extend centrally from each elongated side 66, 68 of the armature 36. This combination limits lateral movement of the armature 36 within the movable contact carrier 30 and prevents any sharp comers of the metallic armature 36 from contacting and prematurely eroding the plastic movable contact carrier 30. That is, with this arrangement, the armature 36 can be stamped manufactured, and the sharp corners that commonly result from the stamping process do not have to be machined away, which further reduces manufacturing expense. Additionally, the plastic carrier 30 can be molded with comer fillets that prevent stress cracks that commonly occur in right angle corners in plastic moldings. FIG. 3 also shows a recess 70 in the armature 36 having an aperture therein. The recess 70 is located on both sides of the armature 36, as best viewed in FIG. 6, to thereby allow the armature to be installed within the carrier with either side facing up, thereby simplifying assembly.

Referring now to FIG. 4, the contactor powerhead 12 is shown in perspective as viewed from a bottom side. The powerhead housing 14, has front and back locking clasps 74, 76 to engage the lower base housing 16, as will be further described with reference to FIG. 5. The powerhead housing 14 has a bottom surface 78 having an armature stop 80 that prevents the floating armature 36 from moving rearwardly during normal operation. Housing 14 also has an armature channel 82 to guide the armature 36 laterally. The armature channel 82 includes a pair of downwardly extending bosses 84, 86 and a front panel 88. Referring to the movable contact carrier 30, a U-shaped lower retention portion 90 spans across the movable contact carrier 30 from the offset ear 38 to the offset ear 40. The U-shaped lower retention portion 90 allows inserting the armature 36 while the movable contact carrier 30 is in the housing in that since the armature 30 is spring-loaded, grasping the offset ears 38 and 40 and pulling downwardly, as viewed in FIG. 4, the armature 36 can clear the armature stop 80 and be inserted forwardly, as indicated by arrow 92.

Figure 5:
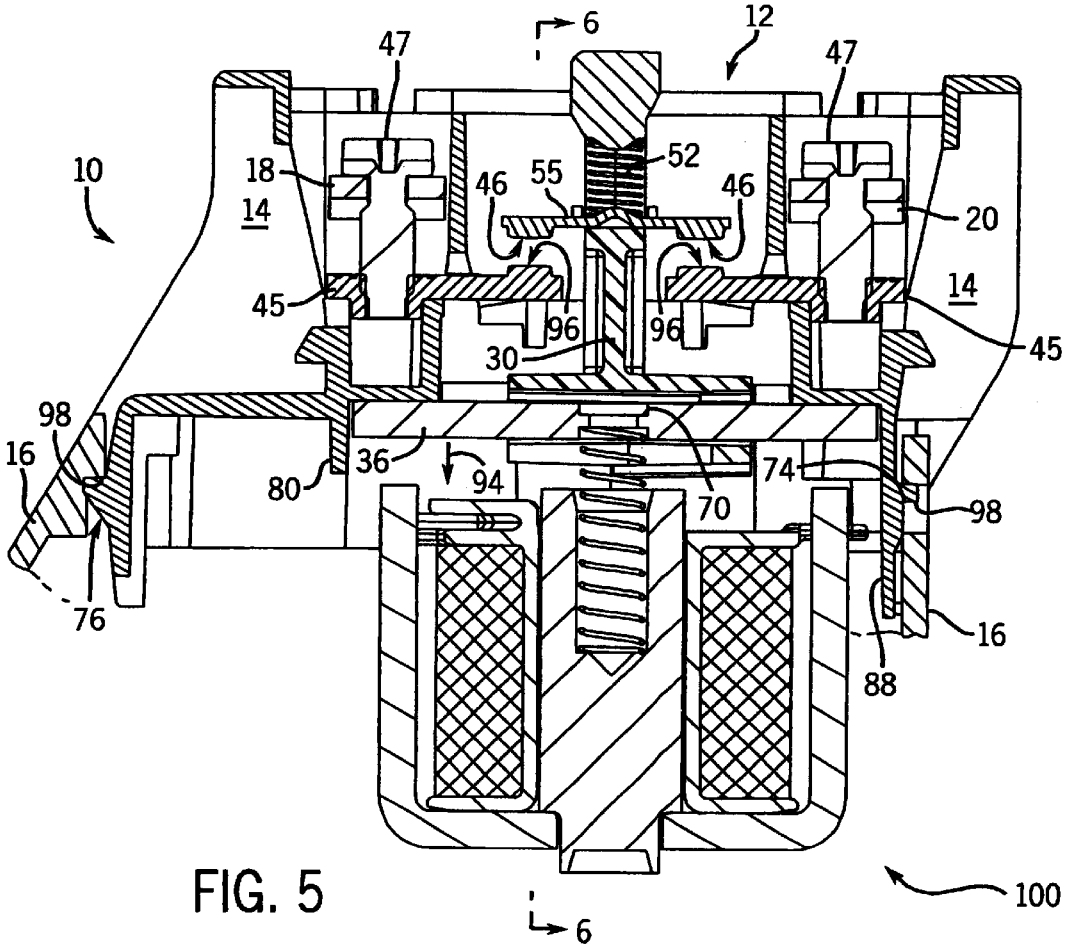
FIG. 5 is a partial cross-sectional, elevation view of the contactor of FIG. 1.
Figure 6:
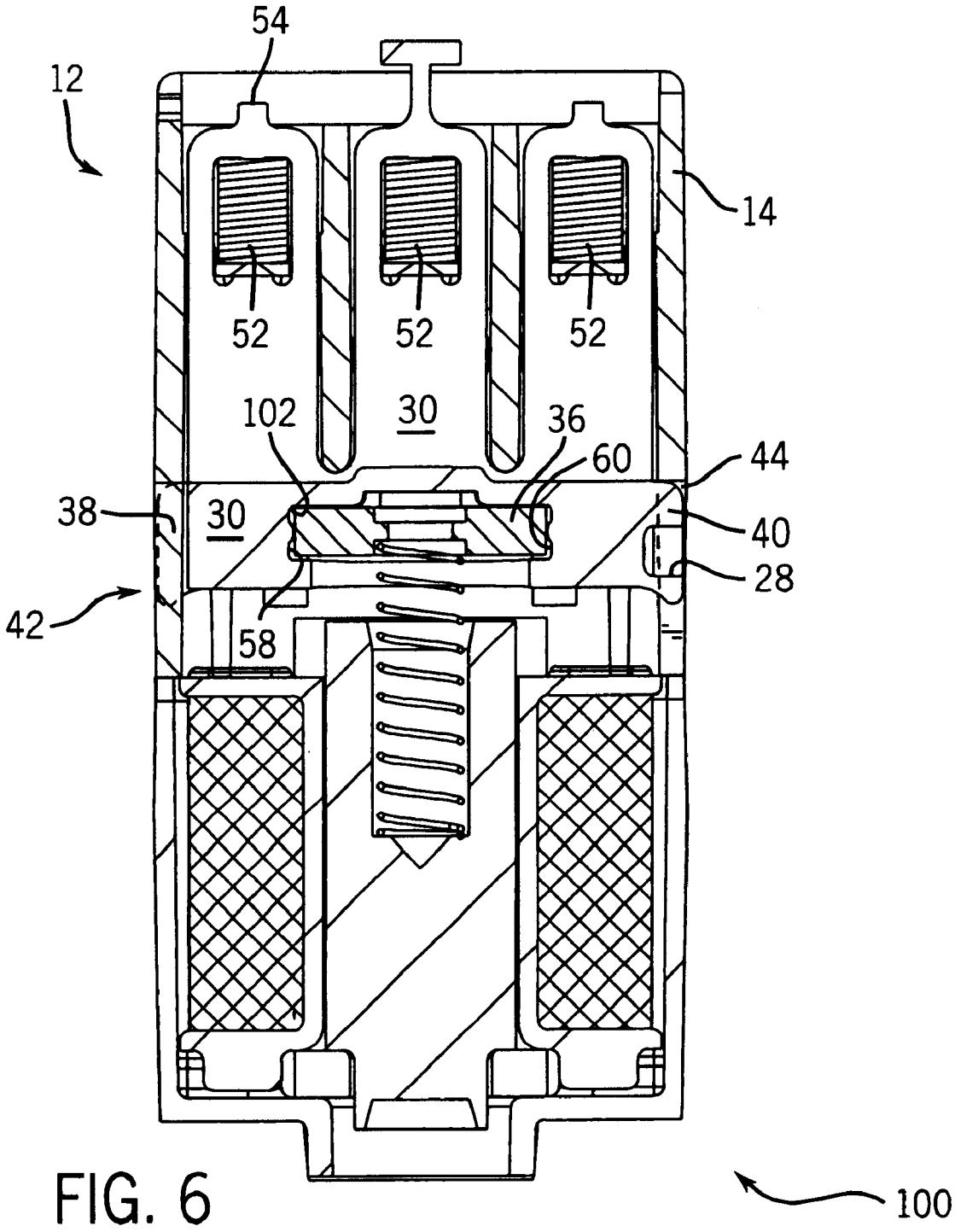
FIG. 6 is a cross-sectional, elevation view taken along line 6—6 of FIG. 5.

Referring now to FIG. 5, the movable contact carrier 30 is shown in a contact open position in which the movable contacts 46, attached to the substrate 55, are in a rest position. When the armature 36 is drawn downwardly, as indicated by arrow 94, by the coil and magnet assembly 100, the movable contact carrier 30 and the movable contacts 46 move downwardly until the movable contacts 46 come in contact with stationary contacts 96, to thereby complete a circuit path between a power source connector 20 and a motor connector at 18. FIG. 5 also shows the connection between the lower base housing 16 and the upper powerhead housing 14. As previously mentioned with reference to FIG. 4, the upper housing has a pair of clasps 74, 76 extending outwardly that engage front and back sockets 98 of FIG. 5 to attach the upper powerhead housing 14 to the lower base housing 16.

Referring to FIG. 6, a cross-sectional view taken along line 6—6 of FIG. 5 shows pressure springs 52 in the movable contact carrier 30 within the powerhead housing 14 of the contactor powerhead 12. The cross-sectional view shows the offset in the offset ears 38 and 40, and the corresponding carrier ear slots 42, 44. That is, the sectional view is taken along the forward offset ear 40 and ear slot 44 such that each are viewed in whole in FIG. 6, while the offset ear 38 and ear slot 42 are shown in phantom behind a section of the housing 14. FIG. 6 also shows the W-shaped side grooves 58, 60 in more detail and the clearance provided between the side grooves 58, 60 and the armature 36. That is, the W-shaped side grooves 58, 60 permit the radius (fillets) in the corners 102 to reduce corner stress. Any sharper corners of the armature 36 are then prevented from contacting the inside fillet corners 102 of the plastic movable contact carrier 30, which thereby prevents premature wear of the carrier.

Accordingly, the present invention includes an electrical contactor having a housing and a set of stationary contacts mounted therein. A set of movable contacts are located within the housing and are in operable association with the stationary contacts. A movable contact carrier has the movable contacts mounted thereon and has an armature slot integrally molded therewith. An armature is provided that is loosely situated in the armature slot of the movable contact carrier so as to float therein and move the carrier between a contact open position and a contact closed position. The contactor housing includes both an upper and a lower housing. The upper housing has front and back locking clasps and the lower housing has front and back sockets to receive the locking clasps therein to attach the upper housing to the lower housing. The movable contact carrier has a pair of offset ears adjacent the armature slot and the housing has two elongated sides that are parallel to a length of the armature. Each elongated side has a carrier ear slot therein to accept the pair of offset ears of the movable contact carrier. The housing has a bottom surface with an armature stop and an armature channel to guide the floating armature. The armature slot has a U-shaped retention portion to allow easy insertion of the armature while the movable contact carrier is mounted within the housing. Because the armature is metallic and the carrier is plastic, the invention includes a combination in which the armature slot of the movable contact carrier has a pair of W-shaped side grooves and the armature has a pair of side extensions. The combination prevents any sharp corners of the armature from contacting radius corners of the plastic carrier. The offset ears of the carrier each have a mechanical interlock aperture on an outer portion that is engageable with another contactor to prevent one contactor from energizing when another is already energized.

The present invention also includes a contactor having a floating armature. The contactor has a housing having a bottom surface with an armature stop and an armature channel to retain the armature during normal operation. A movable contact carrier is provided having an armature slot integrally molded therewith and having side channels to loosely retain the armature therein. The contactor carrier has a pair of offset ears adjacent the armature slot. The housing has two elongated sides that are parallel to a length of the armature, and each elongated side has a carrier ear slot therein to accept a corresponding offset ear of the movable contact carrier therein. The armature slot of the carrier assembly has a U-shaped lower retention portion. A pair of W-shaped side grooves in the armature slot, together with side extensions in the armature limits lateral movement of the armature and prevents any sharp comers of the armature from contacting the inside radius comers of the plastic carrier.

The present invention has been described in terms of the preferred embodiment, and it is recognized that equivalents, alternatives, and modifications, aside from those expressly stated, are possible and within the scope of the appending claims.

What is claimed is:

1. An electrical contactor comprising:

a housing having a set of stationary contacts mounted within the housing and a set of movable contacts located within the housing and in operable association with the stationary contacts;

a movable contact carrier having the set of movable contacts attached thereon and having an armature slot integrally molded therewith;

an armature loosely situated in the armature slot of the movable contact carrier so as to float therein; and a coil and magnet assembly situated in the housing to apply a magnetic force to the armature and thereby move the movable contact carrier between a contact open position and a contact closed position.

2. The contactor of claim 1 wherein the armature is metallic and the carrier is plastic and further comprises a combination wherein the armature slot of the carrier comprises projections on side walls thereof which are abutted by the armature to space the armature away from a plurality of internal corners of the armature slot.

3. The contactor of claim 1 wherein the carrier has a pair of offset ears adjacent the armature slot and the housing has two elongated sides that are parallel to a length of the armature, each elongated side having a carrier ear slot therein to accept one of the pair of offset ears of the carrier therein.

4. The contactor of claim 1 wherein the housing has a bottom surface having an armature stop and an armature channel to guide the armature.

5. The contactor of claim 1 wherein the armature slot of the movable contact carrier has a U-shaped lower retention portion to allow insertion of the armature while the movable contact carrier is in the housing.

6. The contactor of claim 1 wherein the armature is metallic and the carrier is plastic and further comprises a combination wherein the armature slot of the carrier assembly has a pair of W-shaped side grooves and the armature has a pair of side extensions, wherein the combination prevents any sharp comers of the armature from contacting the plastic carrier.

7. The contactor of claim 3 wherein the offset ears each have a mechanical interlock aperture on an outer portion that is engageable with another contactor to prevent one contactor from energizing when another is energized.

8. The contactor of claim 1 wherein the housing has a mounting slot on a lower end for rail mounting the contactor.

9. The contactor of claim 1 wherein opposite sides of the armature are identical to allow the armature to be inserted within the carrier with either side facing the carrier.

10. A contactor having a floating armature comprising:

a movable contact carrier having an armature slot integrally molded therewith, the armature slot having a pair of side grooves to loosely retain a floating armature therein;

a housing with a bottom surface having an armature stop and an armature channel to guide the floating armature; and wherein the movable contact carrier has a pair of offset ears adjacent the armature slot and the housing has two elongated sides that are parallel to a length of the floating armature, each elongated side having a carrier ear slot to accept one of the pair of offset ears of the movable contact carrier therein.

11. The contactor of claim 10 wherein the housing is a powerhead housing having front and back locking clasps, the contactor further comprising a base housing having front and back sockets to receive the front and back locking clasps of the powerhead housing therein and attach the powerhead housing to the base housing.

12. The contactor of claim 10 wherein the armature slot of the movable contact carrier has a U-shaped lower retention portion to allow insertion of the floating armature while the movable contact carrier is assembled in the housing.

13. The contactor of claim 10 wherein the floating armature is metallic and the movable contact carrier is plastic and further comprises a combination wherein the armature slot of the movable contact carrier has a pair of W-shaped side grooves and inside radius comers and the floating armature has a pair of side extensions, wherein the combination limits lateral movement of the floating armature and prevents any sharp comers of the floating armature from contacting the inside radius comers of the plastic carrier.

14. The contactor of claim 10 wherein the offset ears each have a mechanical interlock aperture on an outer portion that is engageable with another contactor to prevent one contactor from energizing when another is already energized.

15. The contactor of claim 10 wherein the housing has a mounting slot on a lower end for rail mounting the contactor.

16. The contactor of claim 10 wherein the floating armature has a recess on two sides to allow the armature to be installed within the carrier with either side facing the carrier.

17. A contactor comprising a powerhead housing having a set of stationary contacts mounted within the powerhead housing and a set of movable contacts in operable association with the stationary contacts;

a movable contact carrier having the movable contacts attached thereon and having an armature slot integrally molded therewith;

an armature loosely situated in the armature slot of the carrier assembly so as to float therein;

a coil and magnet assembly to move the armature and movable contact carrier between a contact open position and a contact closed position;

wherein the movable contact carrier has a pair of offset ears adjacent the armature slot and the powerhead housing has two elongated sides that are parallel to a length of the armature, each elongated side having a carrier ear slot to accept one of the pair of offset ears of the movable contact carrier therein;

wherein the powerhead housing has a bottom surface having an armature stop and an armature channel and the armature slot of the movable contact carrier has a U-shaped lower retention portion; and wherein the armature is metallic and the movable contact carrier is plastic and further comprises a combination wherein the armature slot of the movable contact carrier has a pair of W-shaped side grooves and the armature has a pair of side extensions, wherein the combination prevents any sharp corners of the armature from contacting the inside corners of the plastic carrier.

18. The contactor of claim 17 wherein the powerhead housing comprises front and back locking clasps and a base housing has front and back sockets to receive the front and back locking clasps to attach the powerhead housing to the base housing.

19. The contactor of claim 17 wherein the armature has a recess on two sides to allow the armature to be installed within the movable contact carrier with either side facing up.

20. The contactor of claim 18 wherein the base housing has a mounting slot to rail mount the contactor.

* * * * *